US008012280B1

(12) United States Patent
Thorpe

(10) Patent No.: US 8,012,280 B1
(45) Date of Patent: Sep. 6, 2011

(54) WINDOW FILM APPLICATOR

(76) Inventor: Ricky Thorpe, Davie, FL (US)

( * ) Notice: Subject to any disclaimer, the term of this patent is extended or adjusted under 35 U.S.C. 154(b) by 297 days.

(21) Appl. No.: 12/348,405

(22) Filed: Jan. 5, 2009

Related U.S. Application Data

(60) Provisional application No. 61/019,741, filed on Jan. 8, 2008.

(51) Int. Cl.
*B32B 37/00* (2006.01)

(52) U.S. Cl. ..... 156/71; 156/267; 156/574; 156/579

(58) Field of Classification Search ..... 156/71, 156/574, 579, 580, 250, 267, 510; 425/458
See application file for complete search history.

(56) References Cited

U.S. PATENT DOCUMENTS

| | | | | |
|---|---|---|---|---|
| D191,499 | S * | 10/1961 | Donay | D32/41 |
| D332,160 | S * | 12/1992 | Kuzma | D32/41 |
| 7,225,848 | B2 * | 6/2007 | Williams | 156/574 |
| D546,513 | S * | 7/2007 | Ajluni et al. | D32/46 |

* cited by examiner

*Primary Examiner* — James Sells

(57) ABSTRACT

The present invention discloses a film applicator tool for installing a tint film on the window of an automobile or building. The applicator tool includes a body having a tapered front end, and a blade comprising plastic or urethane rubber disposed along a lateral edge of the body. The applicator tool further includes a control recess formed within the top portion of the body for receiving a finger of a hand. The control recess allows a user to control the position and pressure of the tool when applying a tint film on a window. A thumb opening is formed within the body for wrapping about a thumb of the user. The film applicator tool performs as a squeegee to properly install a tint film material on a window.

13 Claims, 3 Drawing Sheets

WINDOW FILM APPLICATOR

CROSS-REFERENCE TO RELATED APPLICATION

This Non-Provisional Patent Application claims the benefit of U.S. Provisional Patent Application Ser. No. 61/019,741, filed on Jan. 8, 2008, which is incorporated herein in its entirety.

FIELD OF INVENTION

The present invention relates to tools, and more specifically, to a tool for applying a tint film to a window of an automobile or building to reduce glare, block UV rays, maintain privacy, and help keep the interior of the vehicle or building cool.

BACKGROUND OF THE INVENTION

Drivers of automobiles are often subjected to the suns intense rays, or to oncoming lights of passing vehicles while driving. The suns glare or oncoming lights is often bothersome to the driver and can even be dangerous if the suns rays or passing lights are intense enough to prevent the driver from seeing. In certain situations, the suns rays can also heat the interior of the vehicle to uncomfortable levels. Further, because the windows of the automobile are typically transparent, the driver and passengers have a limited amount of privacy as on lookers peer within the vehicle through the windows. To help resolve these problems, manufactures have provided windows including a tinted material that is formed integrally within the glass of the window providing a permanent window tinting. These products have proven to be expensive to manufacture, purchase and replace. As a result of the disadvantages associated with the permanent window tinting, manufactures have created releasably applied tints that are cut to size and dimensioned to cover the surface layout of a window, such as a car window or window of a building. Generally, installing the tint film requires the use of a window film application tool.

Typically, window film applicator tools are used to apply a certain amount of pressure to the film shade to compress the film adequately against the window removing any excess mounting solution and air bubbles associated with the installation process. Some examples of window film applicator tools include a scrapper or squeegee. Many film applicator tools on the market today are too small to handle, do not have enough reach, or the shape of the tool prevents the tool from getting into tight corners or areas. Other disadvantages of prior art applicator tools provide for tools that are too bulky, fragile, uncomfortable to use, or fabricated from a soft material that prevents a user from applying the requisite amount of pressure when installing the tint material adequately on a window.

Accordingly, there remains in the art a need for a window film applicator tool that is inexpensive to manufacture, comfortable to use, and dimensioned to access corners, cracks or small areas. There is also a need for a film applicator tool that includes sufficient reach, and is constructed from a rigid material in order to apply the requisite amount of pressure needed to install a tint material on a window.

SUMMARY OF THE INVENTION

The present invention overcomes the deficiencies of the known art and the problems that remain unsolved by providing a film applicator tool that is easy and comfortable to use, provides sufficient reach, and can be used to access corners or tight areas. Moreover, the overall construction of the film applicator tool provides an integrally formed tool having sufficient rigidity to effectively install a film material.

In accordance with one embodiment of the present invention, there is provided a window film applicator tool for applying a film on the surface of a window comprising a body including a tapered front section forming a lateral edge and a tip end, a blade member disposed along the lateral edge of the front section, a control recess formed within a top portion of the body, opposite the lateral edge of the front section, and a thumb opening formed within the body for wrapping about a thumb.

Preferably, the blade member begins at the tip end of the front section and terminates at a first end of the thumb aperture. The blade member is integrally formed with the body or separately attached to the lateral edge of the front section. The blade member comprises any one of a flexible plastic, a flexible semi-rigid rubber, or urethane rubber.

Preferably, the thumb aperture begins at a distal end of the lateral edge and extends within the body forming a curved aperture defining a first end and a second end. A beveled edge is formed along the outer perimeter of the body. The beveled edge begins at one end of the control recess and extends along the outer edge of the body terminating at the second end of the thumb aperture.

Advantageously, the body comprises any one of plastic, hard rubber, wood, aluminum, glass, ceramic, steel, metal, fiberglass or any combination thereof, and may be transparent, opaque or include one or more colors. Optionally, the film applicator tool may include one or more ribs for enhancing the rigidity of the tool.

In yet another embodiment, there is provided a tool for applying a film on the surface of a window of an automobile or building comprising a body including a tapered front end, a blade disposed along a lateral edge of the body, a control recess formed within a top portion of the body and an orifice formed within the body for wrapping about a thumb of a user. The tool further includes a pressure member forming a pulling end for pulling rubber seals along a window.

Advantageously, the tool includes any shape, dimension, size, or configuration, and may or may not include markings, indicia, letters, or logo.

An alternative embodiment of the present invention includes a method of applying a tint material on a window for reducing glare comprising the steps of constructing an applicator tool comprising a body including a tapered front section forming a lateral edge and a tip end, and including a back section, a blade member disposed along the lower portion of the front section, a control recess formed within a top portion of the body adapted to receive a finger of a user, an opening formed within the body for wrapping about a thumb; and a beveled edge formed along an outer edge of the back section.

The embodiment further includes the step of selecting a film material desired, and cutting the film material to correspond to the shape and size of a window to be covered, and positioning the film material onto the window using a mounting solution.

The applicator tool is positioned within the hand of a user such that a finger of the hand rests within the control recess, and the thumb of the hand is inserted within the opening. The user places the blade member of the applicator tool on the film material and applies moderate pressure as the user swipes the blade member from the center of the window outwards to the windows edges until all the mounting solution is extracted from behind the film material.

DETAILED DESCRIPTION OF THE PRESENT INVENTION

As required, detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular components. In other instances, well-known materials or methods have not been described in detail in order to avoid obscuring the present invention. Therefore, specific structural and functional details, or given dimensions disclosed herein are not limiting but serve as a basis for the claims and for teaching one skilled in the art to variously employ the present invention.

Referring to the Figures, the window film applicator is illustrated as being used for applying a tinted film material to the surface of a car window. Notwithstanding the forgoing detailed description and the drawings provided herein, which makes reference to applying a film on a car window, it will understood to one of ordinary skill in the art that the reference to the car window is for description and is not to be inferred as limiting on the present invention. The present invention may be used for applying a film material in homes, automobiles, commercial or residential buildings or to any suitable surface. It will also be noted that the terms "film", "film shape", "tint", or "film material" refers to any material applied to the surface of a window for reducing the UV rays, light or glare, and to help promote privacy. Thus, the terms may include any of Blackout and Whiteout films, Anti-Graffiti films, Matte films, color films, tinted films, fader films, automotive films, specialty films, solar films or any other film.

Figure 1:
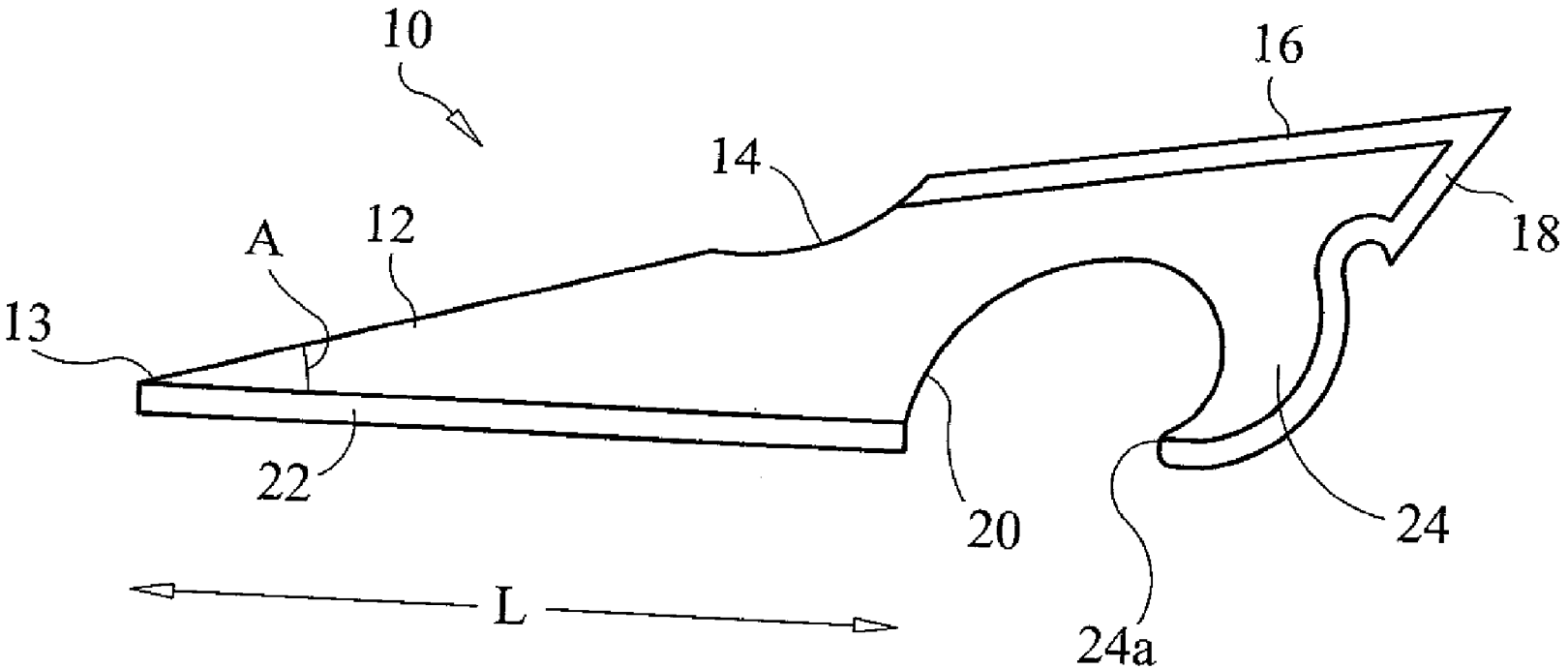
FIG. 1 is a plan view of a window film applicator, according to the embodiment of the present invention

Referring now to the drawings, wherein like numbers represent like elements throughout, FIG. 1 shows a plan view of a window film applicator tool 10, according to the embodiment of the present invention. The film applicator 10 includes a body having a front tapered section 12, a finger control recess 14, a back section 16, a thumb opening 20 formed within the body, a blade member 22 disposed along the lateral edge of the front tapered section 12, and a pressure end 24. As shown, the front tapered section 12 increases in width when approaching the back section 16 defining an angle A converging into a pointed end 13. The front tapered section 12 may comprise any width creating the angle A desired. It will be noted that the front tapered section 12 and the back section 16 may comprise any suitable length, width, size, shape or dimension. In one exemplary embodiment, film applicator tool 10 includes a total length of 13 inches, and a thickness of ⅛ inch. The thickness of tool 10 corresponds to the controlled flexibility or rigidity of the tool 10.

Finger control recess 14 is dimensioned to receive the bottom portion of a finger, such as the index finger, and may or may not include a friction engaging material such as foam or rubber. A finger of a user's hand is disposed within the finger control recess 14 such that the bottom portion of the finger butts against the curved portion of the recess 14 to operatively control the positioning of the tool, and the amount of pressure being applied by the tool 10 when installing a film material 114 on a window 116, 122 of a vehicle 120.

Blade member 22 is disposed along the lateral edge of the front tapered section 12 such that blade member 22 begins at a distal end of the lateral edge of the front section 12 and terminates at a first end formed by thumb opening 20. In one exemplary embodiment, blade member 22 comprises 8.5 inches in length L, and may comprise any suitable width. Blade 22 may be fabricated from any one of a resilient plastic material, a urethane rubber material, a semi-flexible foam material, or any other suitable material for controllably applying pressure to film material 114.

The film applicator tool 10 further includes a thumb opening 20 formed within the body of the tool 10. Thumb opening 20 begins at a first end and extends to form a curved opening within the body of tool 10 terminating at a second end forming a pulling tip 24*a*. Thumb opening 20 is dimensioned and configured to wrap around the thumb of a user when holding the tool 10 in hand. Thumb opening 20 may or may not include friction engaging material such as a hard or soft rubber or foam material affixed along the concave edge or perimeter of the opening 20.

With continued reference to FIG. 1, film applicator tool 10 includes a pressure end 24 forming a pulling tip 24*a*. The pressure end 24 and pulling tip 24*a* aids in applying pressure when installing a film material 114 on a window 116, and 122. The pulling tip 24*a* also aids in pulling up or disengaging rubber seals that are assembled along the outer edge of the window 116, and 122.

Applicator tool 10 further includes a beveled edge 18. The beveled edge 18 begins at one end of the finger control recess 14 and extends along the outer perimeter or edge of the back section 16 and the pressure end 24 to terminate about pulling tip 24*a*. The beveled edge 18 permits the applicator tool 10 to not only fit comfortably within the hand of a user, but to also provide a smooth working contact when the back section 16, pressure end 24, and pulling tip 24*a*, of tool 10, compress the film material 114 against the window 116, 122 of a car 120 or building.

It will be understood that the film applicator tool 10 may be fabricated from any suitable, rigid material including but not limited to plastic, hard rubber, aluminum, wood, metal or any other durable material. Applicator tool 10 may or may not include one or more ribs to increase the tools 10 rigidity, or to provide friction enhancements for firmly holding the tool 10 in hand. In addition, applicator tool 10 may or may not include markings, letters, indicia, characters, figures, or a logo. In one non-limiting example, film applicator tool 10 may include marks, as typically used on a ruler, for measuring the dimensions of the film material 114 or window 116 and 122. Applicator tool 10 may include any length, size or shape and may or may not be translucent, opaque, or comprise one or more colors, if desired.

Figure 2:
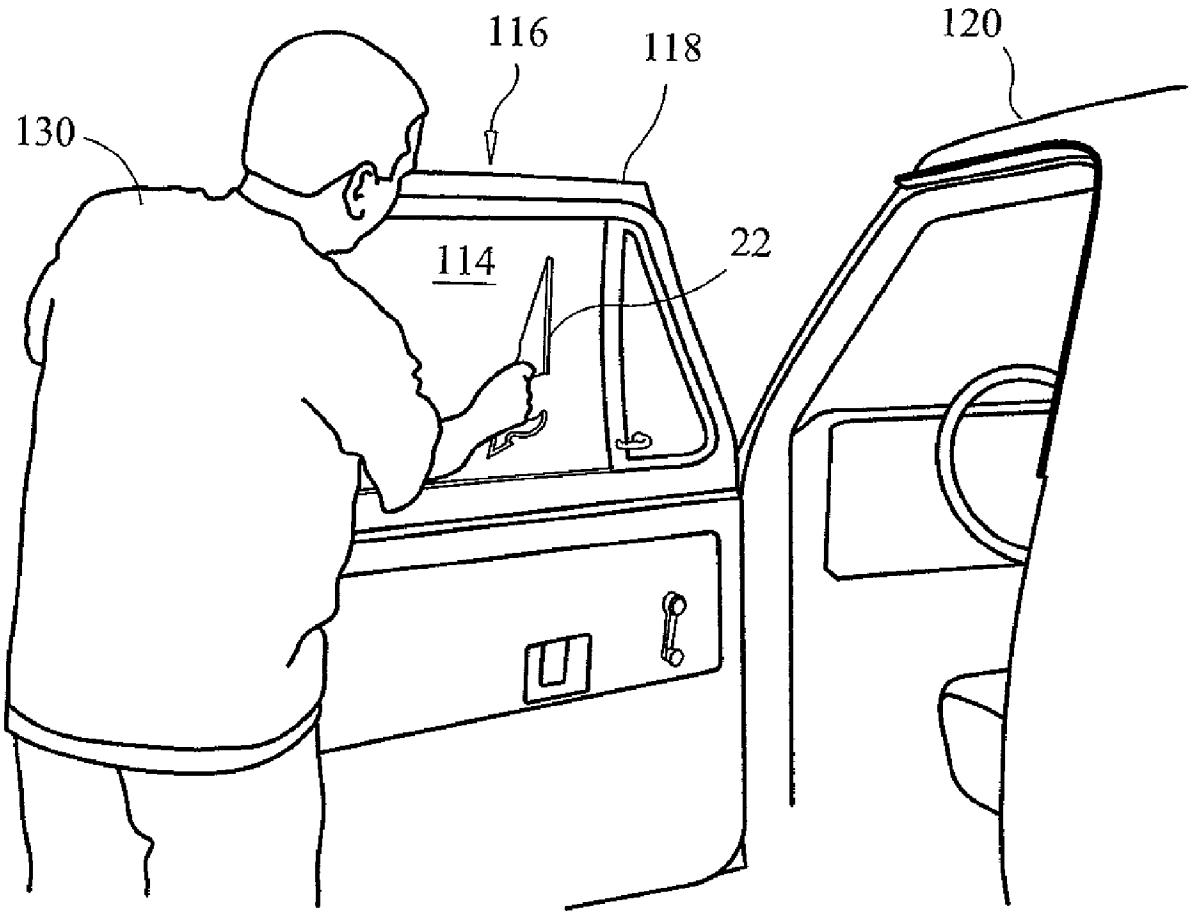
FIGS. 2 and 3 are perspective views of a person applying a tinted film to the surface of a car window using the window film applicator of FIG. 1.
Figure 3:
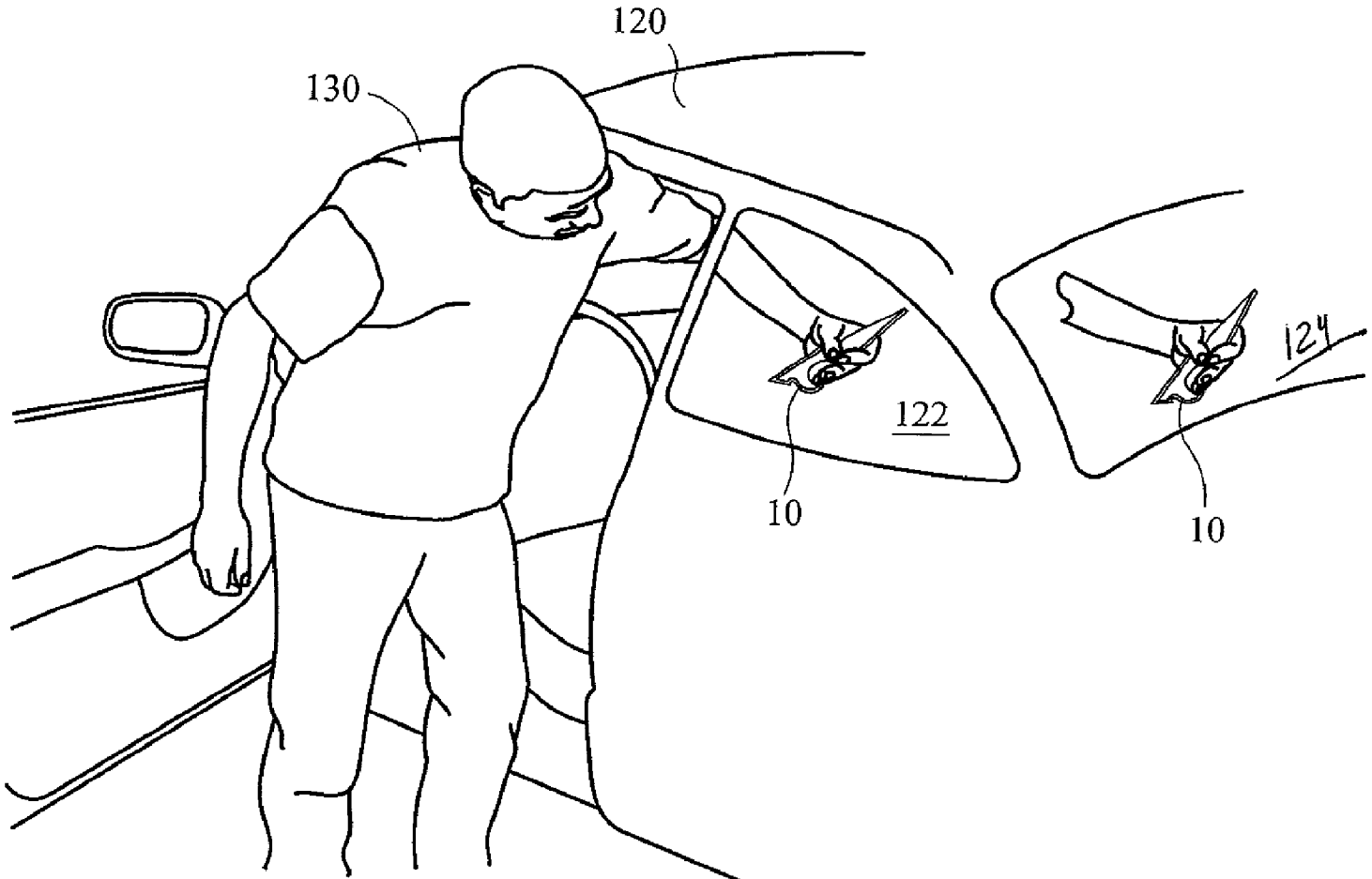

Referring now to FIGS. 2 and 3, there are shown perspective views of a user 130 applying a tint film 114 to the surface of a window 116, 122, of automobile 120, using the window film applicator 10. In preparation of using applicator tool 10, a user 130 first selects the shade of film 114 desired. For example, the user 130 may select any one of Blackout and Whiteout films, Anti-Graffiti films, Matte films, color films, tinted films, fader films, automotive films, specialty films, solar films or any other film. The selected film 114 is then measured and cut to size to correspond to the size and shape of the window 116, 122 desired to be covered. Most films 114 include a protective liner that covers an adhesive side of the film 114. In application, the glass 116, 122 of an automobile 130 is cleaned to remove any dirt, debris, stickers, or the like that may be stuck or lodged on the surface of the window 116 and 122. The protective liner is carefully removed from one side of the film 114 to provide an exposed area. To better assist the user 130 in applying the film 114 on the surface of the window 116, 122, a lubricating material or mounting solution is typically misted and applied to the exposed side of film 114. As a result of the mounting solution applied to the film material 114, the film 114 is easily positioned onto window 116, 122 by sliding the film 114 into place without sticking to the glass.

In use, film applicator tool 10 is positioned within the hand of a user 130 such that a finger, of one hand, is placed within the finger control recess 14, and the thumb of the hand is inserted within the thumb opening 20. The user 130 places the applicator tool 10 such that the blade member 22 is disposed on the film 114 within the center of the window 116 and 122. The user 130 compresses the blade member 22 against the film 114 using moderate pressure, and swipes the applicator tool 10 over the film 114 working from the center of the film 114 outwards towards the edges and corners of the window 116 and 122. The user 130 may use the pressure end 24, and pull tip 24*a* to pull up the rubber seals disposed along the edges of window 116, 122 to fully position the film 114 under the seals.

The user 130 continues the steps of swiping blade 122 over the film 114 until all the mounting solution is pushed out from behind the film 114 and there remains no bubbles. The pointed end or tip 13 of front tapered section 12 allows the user 130 to access the cracks, corners and smaller areas of the window 116 and 122 so that the film 114 is firmly installed in all areas. The beveled edge 18 of the tool 10 can also be used to compress the film 114 onto the window 116 and 122.

The window applicator tool 10 of the present invention offers the advantages of an applicator tool 10 being inexpensive to manufacture and purchase, easy and comfortable to use, and large enough to securely hold in one hand. The overall construction of the applicator tool 10 provides a tool constructed from a rigid material in order to apply the requisite amount of pressure needed to install a tint material 114 to the surface of a window 116 and 122, and includes sufficient reach that is configured to access corners and cracks of windows 116, 122 when installing the film material.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A window film applicator tool for applying a film on the surface of a window, said window film applicator tool comprising:

a body including a tapered front section forming a lateral edge and a tip end;

a blade member disposed along said lateral edge of said front section;

a control recess formed within a top portion of said body opposite said lateral edge of said front section, said control recess adapted to receive a finger of a user;

a thumb opening formed within said body for wrapping about a thumb of the user;

wherein said blade member begins at the tip end of said front section and terminates at a first end of said thumb opening;

wherein said thumb opening begins at a distal end of said lateral edge and extends within said body forming a curved aperture defining said first end and a second end forming a pulling tip;

further including a pressure end beginning at the pulling tip and extending along a horizontal axis curving upwardly; and a beveled edge formed along a portion of the outer perimeter of said body, said beveled edge beginning at one end of said control recess and extending along the outer edge of said body terminating at said pulling tip.

2. The window applicator tool of claim 1, wherein said blade member is integrally formed with said body or separately attached to said lateral edge of said front section, said blade member comprises any one of a flexible plastic, a flexible semi-rigid rubber, or urethane rubber.

3. The window film applicator tool of claim 1, wherein said body comprises any one of plastic, hard rubber, wood, aluminum, glass, ceramic, steel, metal, fiberglass or any combination thereof, said tool including being transparent, opaque or including one or more colors.

4. The window film applicator tool of claim 1, further including one or more ribs for enhancing the rigidity of said tool.

5. A tool for applying a film on the surface of a window of an automobile or building, said tool comprising:

a body including a tapered front end;

a blade disposed along a lateral edge of said body;

a control recess formed within a top portion of said body, said control recess configured to receive a finger of a user;

an orifice formed within said body for wrapping about a thumb of said user;

wherein said blade begins at a tip end of said front end and terminates at a first end of said orifice;

said body further includes a pressure end, and a pulling end for pulling rubber seals along said window;

said orifice begins at one end of said blade and extends within said body forming a curved orifice forming a pulling tip; and further comprising a beveled edge formed along the outer perimeter of a portion of said body, said beveled edge beginning at one end of said control recess and extending along the outer edge of said body terminating at said pulling tip.

6. The tool of claim 5, wherein said blade is integrally formed with or separately attached to said body.

7. The tool of claim 5, wherein said body comprises any one of plastic, hard rubber, wood, aluminum, glass, ceramic, steel, metal, fiberglass or any combination thereof, said tool including being transparent, opaque or including one or more colors.

8. The tool of claim 5, wherein said body includes any shape, dimension, size or configuration, and includes any one of markings, indicia, letters, or logo.

9. A method of applying a tint material on a window for reducing glare comprising the steps of:

providing an applicator tool for applying said film onto a window of an automobile or building, said applicator tool comprising:

a body including a tapered front section forming a lateral edge and a tip end;

a blade member disposed along said lateral edge of said front section;

a control recess formed within a top portion of said body opposite said lateral edge of said front section, said control recess adapted to receive a finger of a user;

a thumb aperture formed within said body for wrapping about a thumb; and a beveled edge formed along an outer edge of said body, said beveled edge beginning at one end of said control recess and extending along said outer edge of said body forming a pulling end;

further including a pressure end beginning at the pulling tip and extending along a horizontal axis curving upwardly;

wherein said blade member begins at the tip end of said front section and terminates at a first end of said thumb opening;

wherein said thumb opening begins at a distal end of said lateral edge and extends within said body forming a curved aperture defining said first end and a second end forming a pulling tip; and applying a tint material on a window using said applicator tool.

10. The method of claim 9, further including the step of selecting a film material desired, and cutting the film material to correspond to the shape and size of a window to be covered.

11. The method of claim 10, further including the step of positioning said film material onto said window using a mounting solution.

12. The method of claim 11, further including the step of positioning the applicator tool within the hand of a user so that a finger said hand rests within said control recess, and said thumb aperture wraps around a thumb of said hand.

13. The method of claim 12, further including the step of placing the blade member of said applicator tool on said film material and applying pressure as the user repeatedly swipes said blade member from the center of said window outwards to the edges of said window until all mounting solution has been fully extracted from behind said film material.

* * * * *